US005834670A

United States Patent [19]

Yumura et al.

[11] Patent Number: 5,834,670

[45] Date of Patent: *Nov. 10, 1998

[54] KARAOKE APPARATUS, SPEECH REPRODUCING APPARATUS, AND RECORDED MEDIUM USED THEREFOR

[75] Inventors: Takeshi Yumura, Neyagawa; Hiroki Ohnishi; Masanori Miyatake, both of Hirakata; Masashi Ochiiwa, Ogaki; Takashi Izumi, Anpachi-gun; Terukazu Sawada, Ibaraki, all of Japan

[73] Assignee: Sanyo Electric Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 565,403

[22] Filed: Nov. 30, 1995

[30] Foreign Application Priority Data

May 29, 1995 [JP] Japan ..... 7-130770

[51] Int. Cl.[6] ..... G10H 1/36; G10H 1/08

[52] U.S. Cl. ..... 84/610; 84/609; 84/622; 84/634; 434/307 A

[58] Field of Search ..... 84/609, 610, 622–625, 84/634, 666; 434/307 A

[56] References Cited

U.S. PATENT DOCUMENTS

| | | | |
|---|---|---|---|
| 4,639,877 | 1/1987 | Raymond et al. | 364/513.5 |
| 5,243,123 | 9/1993 | Chaya | 84/609 |
| 5,481,509 | 1/1996 | Knowles | 369/30 |
| 5,525,062 | 6/1996 | Ogawa et al. | 434/307 A |
| 5,559,927 | 9/1996 | Clynes | 395/267 |

*Primary Examiner*—David S. Martin
*Assistant Examiner*—Marlon T. Fletcher
*Attorney, Agent, or Firm*—Armstrong, Westerman, Hattori, McCleland & Naughton

[57] ABSTRACT

A karaoke apparatus, a speech reproducing apparatus and a medium on which is recorded a computer program used therefor which output narration of synthesized speech including a requested song name, a requester's name or the like together with an introduction or an interlude of a song, thereby to relieve the boredom of participants during the introduction or the interlude, or the apparatus and the medium which synthesize speech of a chorus, or convert a characteristic of speech input thorough a microphone into a speech characteristic of a professional singer or the like thereby to excite participants.

5 Claims, 7 Drawing Sheets

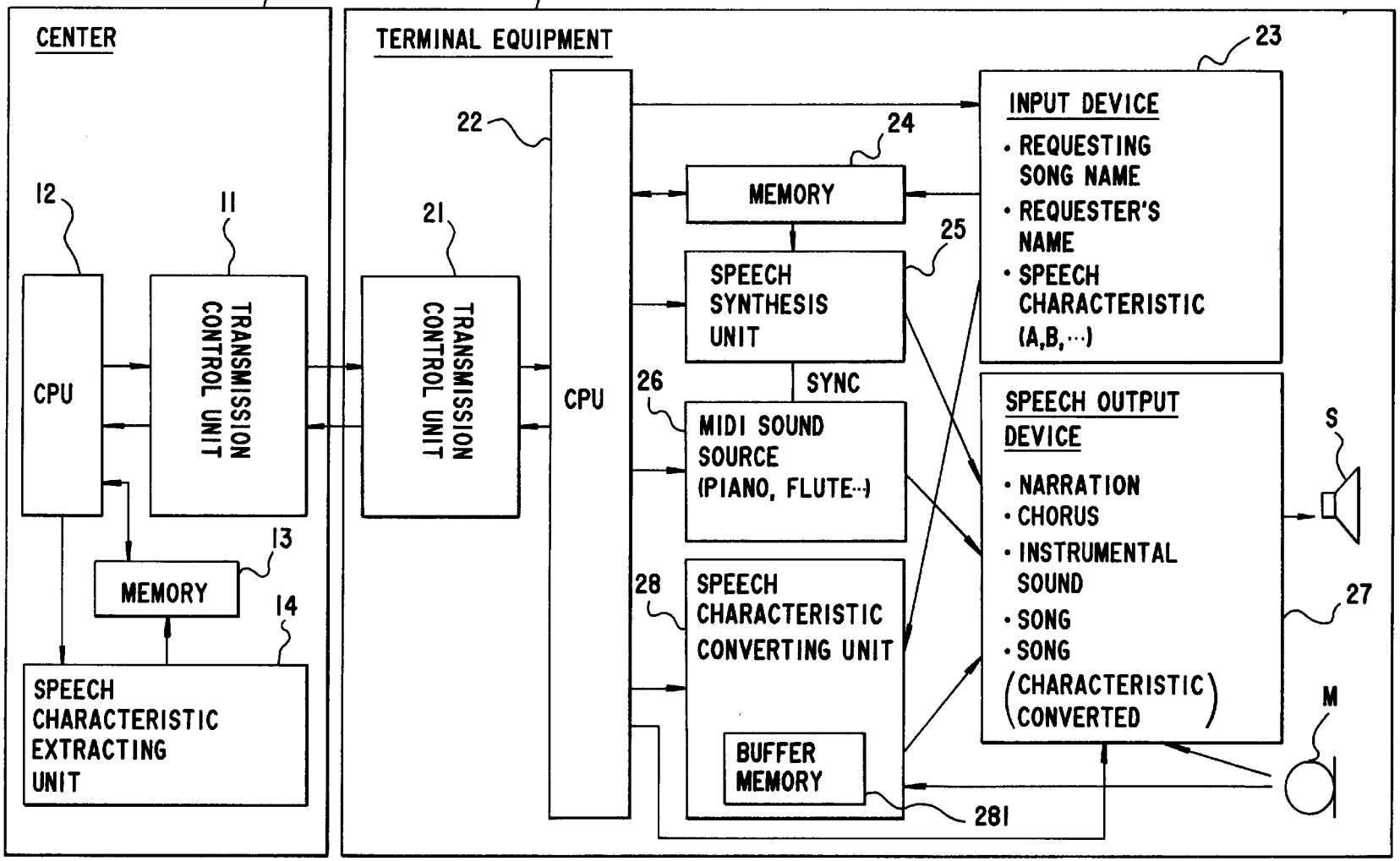
FIG.1
CENTER
1
TRANSMISSION CONTROL UNIT
11
CPU
12
MEMORY
13
SPEECH CHARACTERISTIC EXTRACTING UNIT
14
TERMINAL EQUIPMENT
2
TRANSMISSION CONTROL UNIT
21
CPU
22
INPUT DEVICE
• REQUESTING SONG NAME
• REQUESTER'S NAME
• SPEECH CHARACTERISTIC (A,B,···)
23
MEMORY
24
SPEECH SYNTHESIS UNIT
25
SYNC
MIDI SOUND SOURCE (PIANO, FLUTE···)
26
SPEECH OUTPUT DEVICE
• NARRATION
• CHORUS
• INSTRUMENTAL SOUND
• SONG
• SONG (CHARACTERISTIC CONVERTED)
27
SPEECH CHARACTERISTIC CONVERTING UNIT
28
BUFFER MEMORY
281
S
M

KARAOKE APPARATUS, SPEECH REPRODUCING APPARATUS, AND RECORDED MEDIUM USED THEREFOR

BACKGROUND OF THE INVENTION

1. Field of the Invention

The present invention relates to a karaoke (i.e. music minus one (=vocal)) apparatus for reproducing an accompaniment of a requested song, to a speech reproducing apparatus for outputting speech from a speaker or the like, which is input through a microphone and so on, and to a recorded medium used therefor.

2. Description of the Related Art

A karaoke apparatus takes searching time until selecting an accompaniment of a requested song from among a lot of stored songs. Therefore, a prerequest function is prepared for searching the accompaniments of other songs to play than the currently playing song during the playing in order to exclude the searching from between one song to another thereby playing the songs almost without a break.

When a plurality of people participate one karaoke apparatus and prerequest many songs by making use of the above-mentioned prerequest function, the requester may forget actual prerequesting song until the accompaniment of the song is played.

In a karaoke system via communication, a center, storing data of a plurality of songs, transmits the data of songs to a terminal connected with the center via a telecommunication line. In such a karaoke system is stored rendition data of accompaniments in the center. The rendition data meets a MIDI (Musical Instrument Digital Interface) standard in which a tone, a musical interval, volume and the like of the accompaniment are expressed by numerical data for improving the quality of sound. In the system, a MIDI sound source such as a synthesizer provided in the terminal is controlled by the rendition data transmitted from the center to output an electronic sound. Since the MIDI sound source makes it possible to reproduce instrumental sounds, but impossible to reproduce a voice of a chorus.

Further, if an introduction or an interlude is so long, both a singer and a listener are bored during the introduction or the interlude.

SUMMARY OF THE INVENTION

The present invention was devised to overcome the aforementioned problems. A main object of the invention is to provide a karaoke apparatus, a speech reproducing apparatus and a recorded medium used therefor to excite the participants thereby adding value to the apparatus.

A karaoke apparatus and a recorded medium in the present invention synthesize speech of narration suitable for reproducing a song and output the synthesized speech of narration during an introduction, during an interlude, or just before starting reproduction of a song. When outputting the synthesized speech of narration including a requester's name, during an introduction or just prior to the reproduction, the requester is ascertained. When outputting the narration during an introduction or during an interlude, participants are relieved of the boredom of the long introduction or the long interlude.

A karaoke apparatus and a recorded medium in the present invention further synthesize speech of narration suitable for the genre of the song, such as a ballad, pops, and so on.

A karaoke apparatus and a recorded medium in the present invention synthesize speech of a chorus on the basis of both word data and rendition data of the chorus, and output the synthesized speech of the chorus at a time when the song should be chorused. Consequently, the chorus can be attached to the song even in the circumstances of processing the MIDI standard rendition data.

A karaoke apparatus, a speech reproducing apparatus, and a recorded medium used therefor of the invention convert speech characteristic of input speech to the characteristic selected by a user from among speech characteristics respectively peculiar to plural singers or the like, and output the speech of the converted characteristic as the reproduction of the input speech. Consequently, a user's voice is output as if it were a specified singer's voice by utilizing the specified singer's speech characteristic data base which has been previously registered and a speech characteristic converting technique.

The above and further objects and features of the invention will more fully be apparent from the following detailed description with accompanying drawings.

BRIEF DESCRIPTION OF THE DRAWINGS

FIG. 1 is a block diagram of a karaoke apparatus of the invention;

DESCRIPTION OF THE PREFERRED EMBODIMENTS

Figure 2:
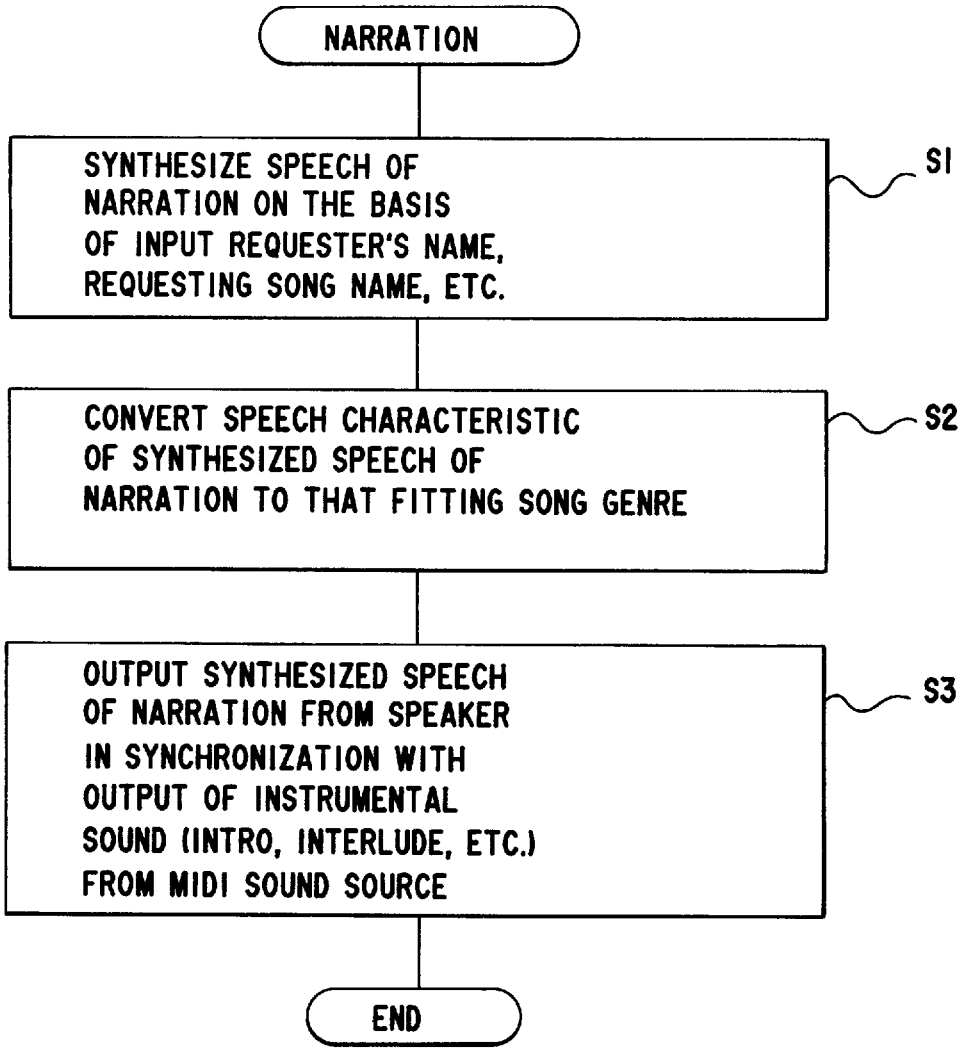
FIG. 2 is a flowchart showing the procedure of outputting narration data by the karaoke apparatus of the invention.

FIG. 1 is a block diagram showing the configuration of a karaoke apparatus of the invention. In the drawing, numeral 1 denotes a center where rendition data of a number of songs are stored. The center 1 includes a transmission control unit 11, a CPU 12, a memory 13 and a speech characteristic extracting unit 14. The transmission control unit 11 controls the transmission of data between the center 1 and a terminal equipment 2 installed in a store or in a home. The memory 13 stores rendition data of the MIDI standard, words data, chorus words data relating to the rendition data of the chorusing portion, and genre data of a song, together with speech characteristic data ($f_A$, $f_B$, . . . ) of professional singers (A, B, . . . ) by singer, for example. The speech characteristic extracting unit 14 extracts speech characteristic data peculiar to each singer from a frequency spectrum of speech of the each singer and stores the extracted data in the memory 13. The CPU 11 controls behavior of each of the units.

The terminal equipment 2 is connected with the center 1 via a telecommunication line. The terminal equipment 2 has a transmission control unit 21 to which is transmitted the rendition data, the words data, the chorus words data, the genre data of the song, the speech characteristic data by singer and so on, and stores the transmitted data in a memory 24 or in a buffer memory 281.

An input device 23 of the terminal equipment 2 is means for a user to input a requesting song name, a requester's name, a singer's name (A, B, . . . ) to which speech characteristic desirable to be converted. A prerequesting song name and a prerequester's name input through the input device 23 are stored in the memory 24. In the memory 24, a computer program for controlling behavior of each of the units in the terminal equipment 2 is also stored, according to which the CPU 22 controls behavior of each unit.

A speech synthesis unit 25 synthesizes speech of narration in a natural tone, including an introduction of a requester on the basis of the requesting song name and requester's name. The speech synthesis unit 25 further converts speech characteristic of the synthesized speech into that suitable for the genre of the song. That is to say, the unit 25 converts the characteristic to be cheerful for pops, gentle for a ballad, for example, on referring to the genre data of the song transmitted from the center 1 together with the rendition data. The speech synthesis unit 25 also synthesizes speech of a chorus on the basis of the chorus words data and a musical interval included in the rendition data relating to the chorus words data both transmitted from the center 1.

A MIDI sound source 26, such as a synthesizer, is controlled by the rendition data of the MIDI standard transmitted from the center 1 to output electronic instrumental sounds of a piano, flute and so on from a speaker S.

A speech synthesis unit 25 outputs the synthesized speech of narration from the speaker S via a speech output device 27 during an introduction, during an interlude, or just prior to starting to reproduce a song in synchronization with the prescribed timing such as starting of an output of an instrumental sound for the introduction or the interlude from the MIDI sound source 26, receiving of the rendition data from the center 1 at the terminal equipment 2, or the like. The speech synthesis unit 25 outputs the synthesized speech of the chorus from the speaker S via the speech output device 27 in synchronization with the prescribed timing such as an output of an instrumental sound for the chorusing portion from the MIDI sound source 26.

A speech characteristic converting unit 28 has the buffer memory 281 for storing speech characteristic data by singer transmitted when, for example, being connected with the center 1 by the telecommunication line. The speech characteristic converting unit 28 extracts a speech characteristic from a frequency spectrum or the like of the speech input through a microphone M. The speech characteristic converting unit 28 further converts the extracting speech characteristic to the characteristic of a singer selected through the input device 23 and read out from the buffer memory 281. Then, the unit 28 outputs speech, in the same way of singing as it was but having the characteristic of the selected singer, from the speaker S via the speech output device 27.

Figure 3:
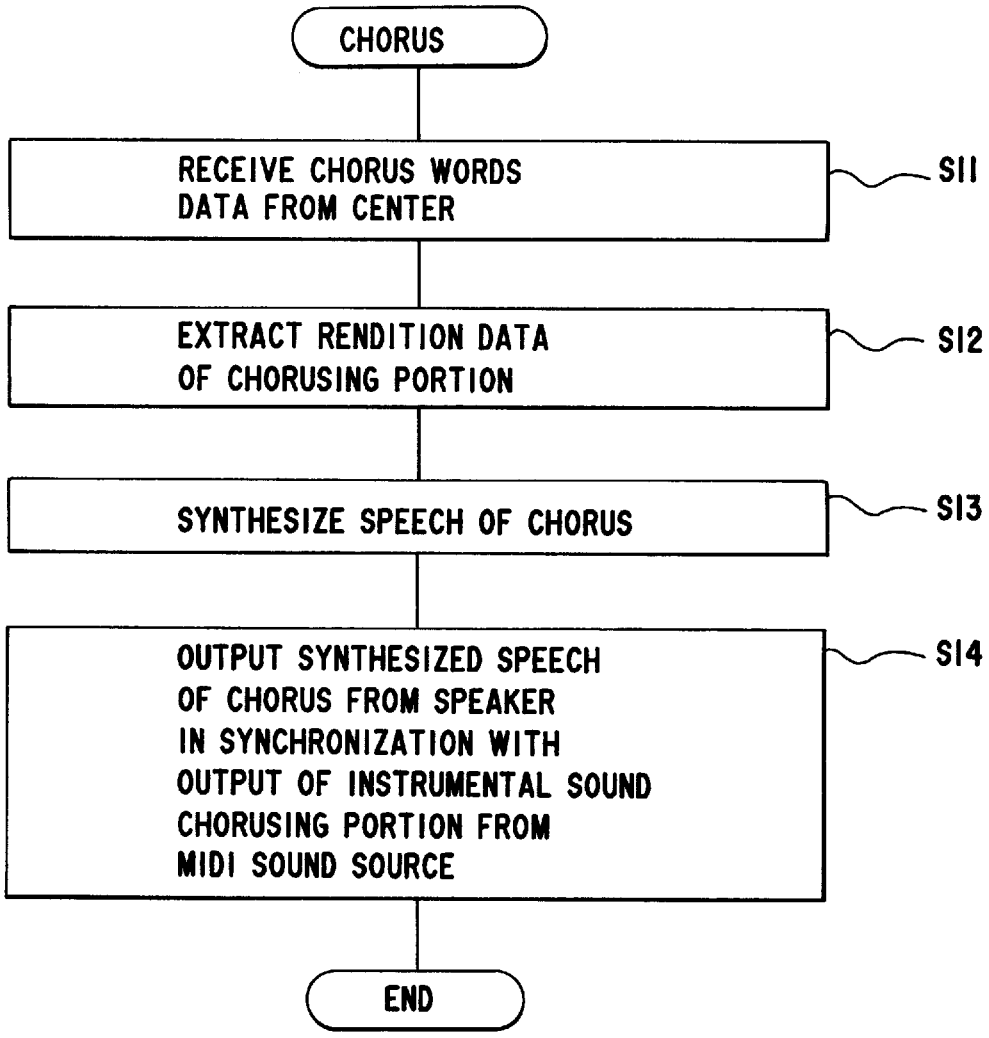
FIG. 3 is a flowchart showing the procedure of outputting chorus data by the karaoke apparatus of the invention.
Figure 4:
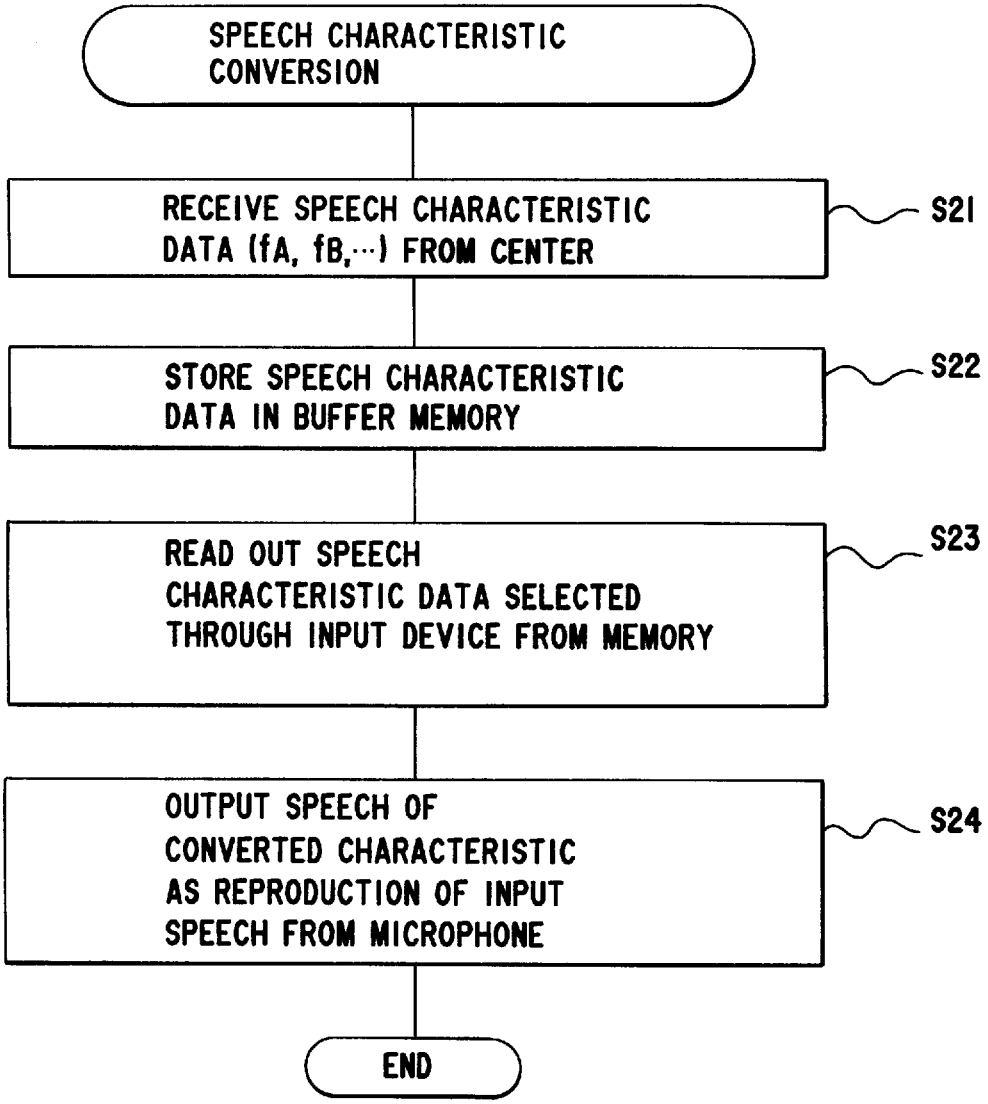
FIG. 4 is a flowchart showing the procedure of converting speech characteristics by the karaoke apparatus of the invention.

The procedures of synthesizing speech of narration, a chorus, or of converting speech characteristic by the karaoke apparatus of the invention will be explained according to flowcharts shown in FIGS. 2 through 4.

When attaching narration to a rendition of a song, the speech synthesis unit 25 synthesizes speech of narration including an introduction of a song, a singer (a requester), and the like on the basis of a requester's name, a requested song name and so on input through the input device 23 (S1). The speech synthesis unit 25 converts the synthesized speech of narration into that suitable for the song with reference to genre data transmitted from the center 1 together with rendition data (S2). The CPU 22 detects an introduction or an interlude of the song according to rendition data for controlling the MIDI sound source 26 in order to let the speech output device 27 output the synthesized speech of narration from the speaker S in synchronization with an output of an instrumental sound of the introduction or the interlude from the MIDI sound source 26 to the speaker S (S3). Consequently, narration is reproduced along with music.

Figure 5:
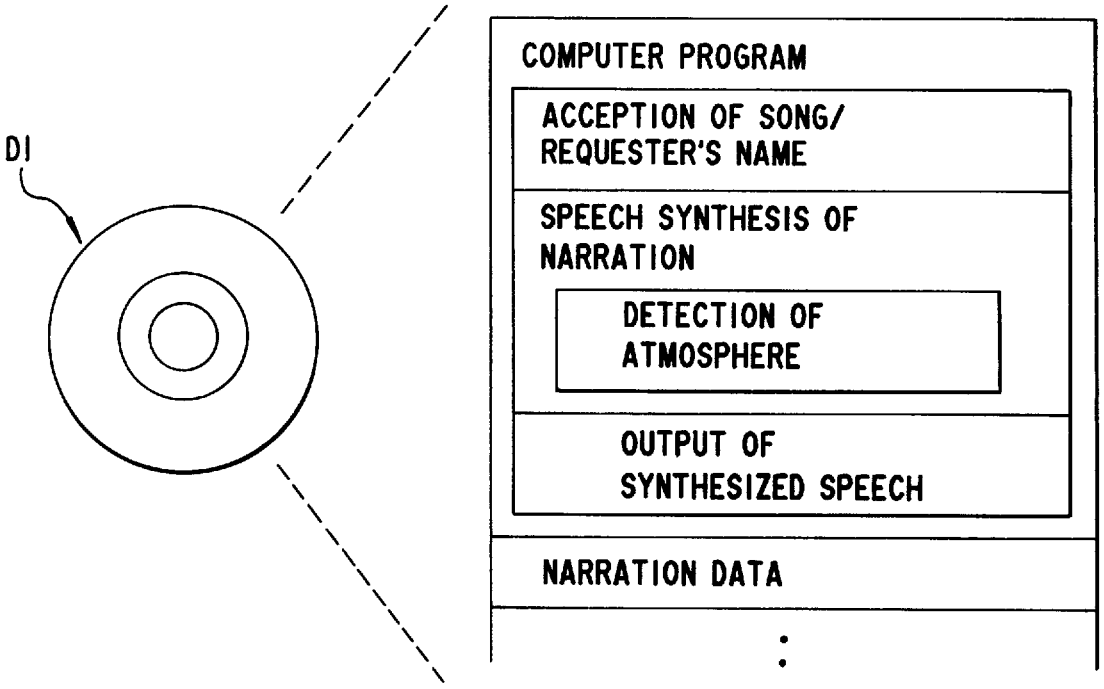
FIG. 5 is a conceptual diagram showing the recorded state of a medium of the invention.

A computer program of the above-mentioned procedure of attaching synthesized speech of narration to a rendition may not be written in the memory 24 of the terminal equipment 2 having the construction as shown in FIG. 1, but may be written in a recording medium D1 such as a compact disk as shown in FIG. 5. Therefore, a karaoke apparatus, a personal computer having a karaoke function or the like may read data from such recording medium D1 to synthesize speech of narration.

When attaching a chorus to a song, on receipt of chorus words data from the center 1 by the transmission control unit 21 (S11), the CPU 22 extracts rendition data for the chorusing portion (S12). The speech synthesis unit 25 synthesizes speech of the chorus from the chorus words data on the basis of a musical interval included in the rendition data extracted by the CPU 22 (S13). The CPU 22 outputs the synthesized speech of the chorus from the speaker S in synchronization with an output of an instrumental sound of the chorusing portion from the MIDI sound source 26 (S14).

When converting a speech characteristic of a person who sings a song using a microphone M, the transmission control unit 21 of the terminal equipment 2 receives speech characteristic data ($f_A$, $f_B$, . . . ) from the center 1 (S21). The CPU 22 stores the received data in the buffer memory 281 in the speech characteristic converting unit 28 (S22). When a name of a singer (A, B, . . . ) having a speech characteristic desirable to be converted is selected, the speech characteristic converting unit 28 reads out the speech characteristic data of the selected singer from the buffer memory 281 (S23). The speech characteristic converting unit 28 converts the characteristic of speech input through the microphone M to that of the selected one, then outputs speech of the selected singer from the speaker S (S24).

Figure 6:
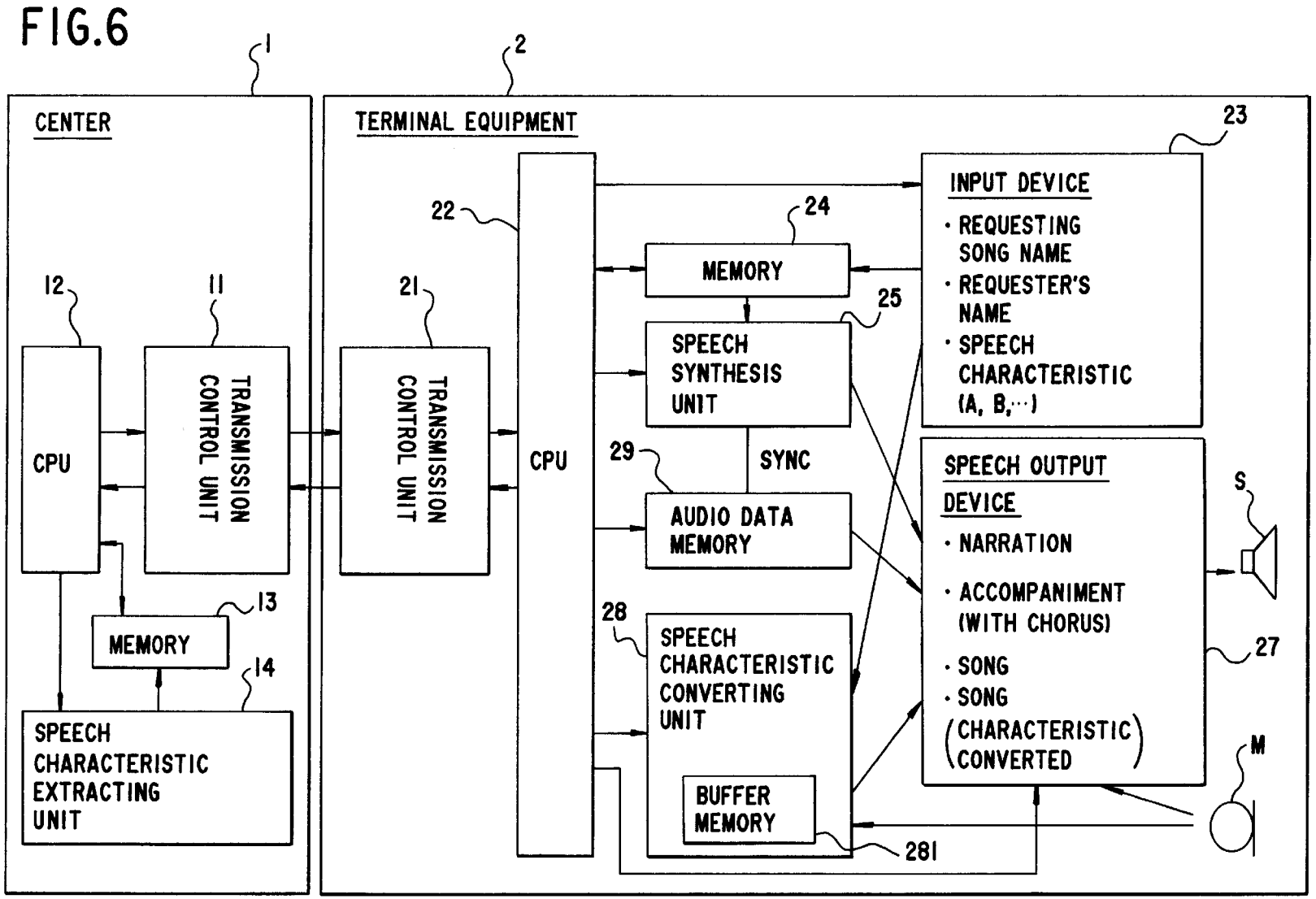
FIG. 6 is a block diagram of a modification of a karaoke apparatus of the invention.

FIG. 6 is a block diagram showing the configuration of a modification of the karaoke apparatus of the invention. In the figure, the same parts as in FIG. 1 are denoted by the same numeral and the explanation will be omitted.

In this modification, the memory 15 of the center 1 stores an audio signal of a song together with an audio signal of a chorus if any, instead of the rendition data of the MIDI standard. Therefore, the terminal equipment 2 is provided with an audio data memory 29 in place of the MIDI sound source 26, for storing the audio data transmitted from the center 1 when the telecommunication line is not busy.

This modification also has functions of synthesizing speech of narration and of converting a characteristic of speech input from a microphone like the above-mentioned embodiment.

Besides, the karaoke apparatus via communication may transmit data through transmission means other than the telecommunication line, such as a cable of a cable television. Moreover, this invention may be effective in a so-called CD karaoke apparatus, a so-called LD karaoke apparatus and the like without using any transmission means.

Figure 7:
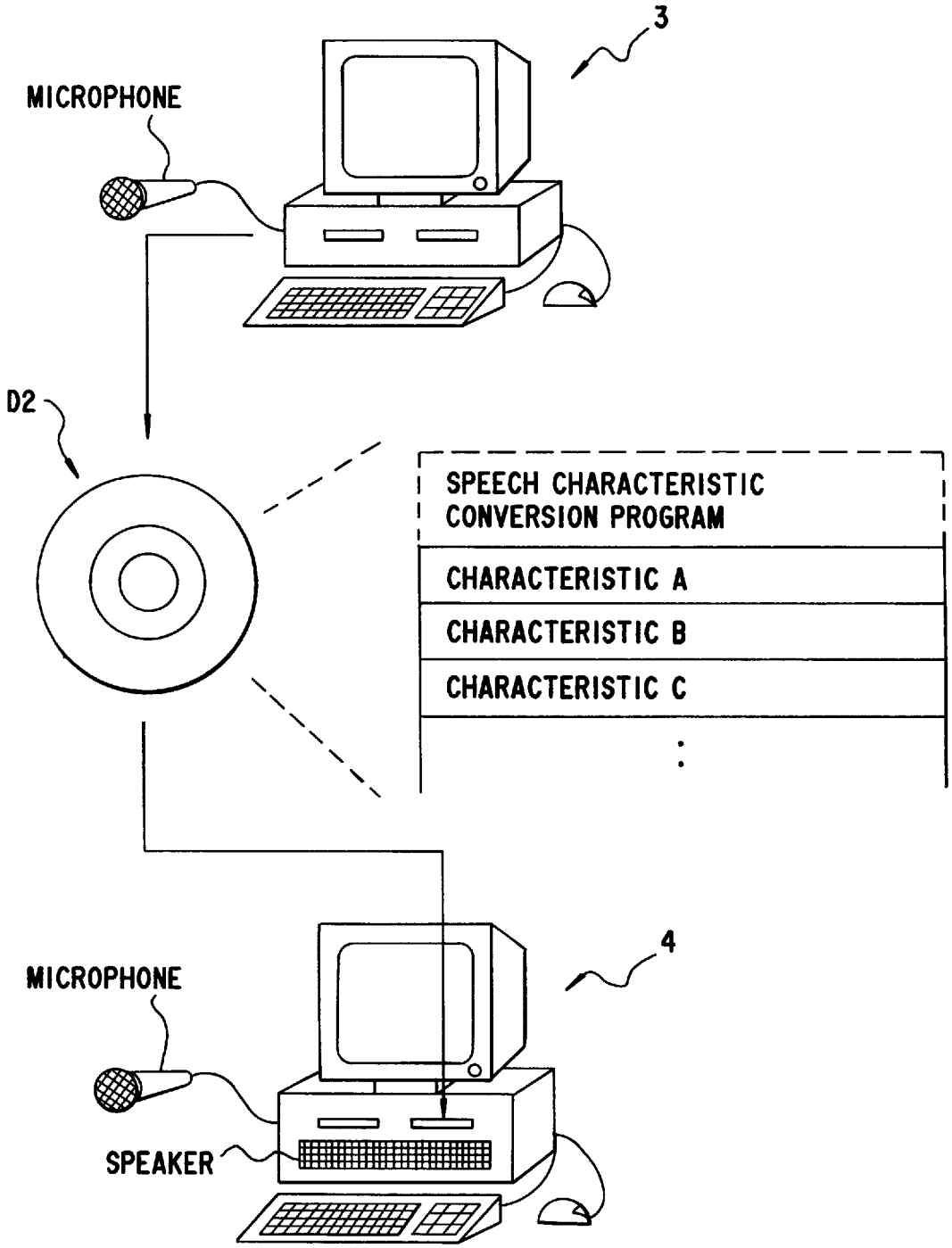
FIG. 7 is a conceptual diagram showing the recorded state of a medium of the invention and a schematic diagram of a speech reproducing apparatus of the invention.

FIG. 7 is a conceptual diagram showing the recorded state of the medium of the invention and a schematic diagram of an embodiment of a sound reproducing apparatus of the invention.

In a recording medium D2 is recorded a library of a plurality of kinds of A, B, C, . . . speech characteristic data.

Such speech characteristic data is obtained by a personal computer 3 capable of processing an audio signal, which extracts a peculiar speech characteristic from a frequency spectrum of speech input through a microphone, and stores the extracting speech data in the recording medium D2 relating to data specifying the kind of speech, such as a singer's name.

By applying the recording medium D2 instead of the speech characteristic extracting unit 14 and the memory 15 of the center 1 in the karaoke apparatus via communication as shown in FIG. 1, the karaoke apparatus via communication, having such configuration that a terminal equipment 2 reads speech characteristic data from the recording medium D2 and stores the data in a buffer memory, becomes able to convert a speech characteristic.

Besides, a sound reproducing apparatus 4 such as a so-called CD karaoke apparatus, a so-called LD karaoke, a personal computer having a karaoke function, or a CD player which does not use transmission means but is provided with at least inputting and outputting means of speech, and executing means of a computer program, is able to convert a speech characteristic. In this case, the sound reproducing apparatus 4 executes a computer program of converting a speech characteristic recorded in addition to the speech characteristic data in the recording medium D2.

Moreover, the invention is applicable not only to a karaoke apparatus but to a sound reproducing apparatus for inputting and outputting a voice.

Besides, not only speech characteristics by singer but the speech characteristic in singing whose feature is extracted from a frequency spectrum of speech data by singing in a ballad style, in an opera style may be applicable.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A karaoke apparatus for reproducing an accompaniment of a requested song comprising:

means for inputting a title of a song and a person's name;

means for selecting a genre of the song;

means for synthesizing speech of narration including the title of a song and/or the person's name; and means for outputting the synthesized narration at a prescribed time in relation to the reproduction of the accompaniment of the song, wherein said means for synthesizing speech synthesizes speech of narration fitted to the selected genre of the song.

2. A karaoke apparatus as set forth in claim 1, wherein said means for outputting the synthesized speech outputs the narration during an introduction.

3. A karaoke apparatus as set forth in claim 1, wherein said means for outputting the synthesized speech outputs the narration during an interlude.

4. A karaoke apparatus as set forth in claim 1, wherein said means for outputting the synthesized speech outputs the narration prior to reproduction of the accompaniment of the song.

5. A method for reproducing an accompaniment of a requested song including a medium on which is recorded a computer program implementing said method, comprising the steps of:

inputting a title of a song and a person's name;

selecting a genre of the song;

synthesizing speech of narration including the title of the song and/or the person's name; and outputting the synthesized narration at a prescribed time in relation to the reproduction of the accompaniment of the song, wherein the synthesized speech of narration is fitted to the selected genre.

* * * * *